United States Patent [19]

Baker

[11] Patent Number: 4,921,185

[45] Date of Patent: May 1, 1990

[54] YARN HOLDER AND DISPENSER

[76] Inventor: Laurna J. Baker, Rt. #1, Box 179, Shady Point, Okla. 74956

[21] Appl. No.: 329,791

[22] Filed: Mar. 27, 1989

[51] Int. Cl.[5] ..... B65H 49/32

[52] U.S. Cl. ..... 242/129.6; 223/107; 242/134; 242/139

[58] Field of Search ..... 242/129.6, 129.62, 129.7, 242/129.71, 129.5, 134, 139, 141, 130, 68, 73; 223/106, 107; 66/1 A

[56] References Cited

U.S. PATENT DOCUMENTS

| | | | |
|---|---|---|---|
| 623,292 | 4/1899 | Sell | 223/107 |
| 928,207 | 7/1909 | Miller | 223/107 |
| 1,066,319 | 7/1913 | Powell | 242/73 |
| 1,604,683 | 10/1926 | Eberhart | 223/107 |
| 1,832,850 | 11/1931 | Audino . | |
| 2,085,636 | 6/1937 | Collins | 242/115 |
| 2,147,216 | 2/1939 | Raasch | 242/134 |
| 2,488,852 | 11/1949 | Cossette | 242/129.6 |
| 2,823,842 | 2/1958 | Huff | 223/107 |
| 3,383,071 | 5/1968 | Godson | 242/129.6 |
| 3,542,041 | 11/1970 | Mercorella | 132/46 |
| 3,593,936 | 7/1971 | Davis | 242/73 |
| 3,731,792 | 5/1973 | Rolston | 206/52 |
| 4,022,394 | 5/1977 | Gudde | 242/129.6 |
| 4,059,243 | 11/1977 | Hartley | 242/129.6 |
| 4,112,711 | 9/1978 | Tripp | 66/1 A |
| 4,641,454 | 2/1987 | Ray | 43/26 |
| 4,752,047 | 6/1988 | Franks, Jr. | 242/129.6 |

*Primary Examiner*—Stanley N. Gilreath
*Attorney, Agent, or Firm*—Head & Johnson

[57] ABSTRACT

An assembly for holding and dispensing yarn from a skein of yarn includes a frame, a spindle and a basket. The frame is collapsible with two pairs of pivotally crossed legs spaced by four horizontal rods connecting the upper and lower portions of oppositely faced legs. Two of the legs are upwardly extended to a pair of journals which rotatably support the spindle which will hold a skein of yarn. The basket is formed from a piece of T-shaped cloth. Fasteners disposed on the cloth permit it to be detachably suspended from the upper horizontal rods and detachably folded into basket shape around the upper and lower horizontal rods.

21 Claims, 2 Drawing Sheets

YARN HOLDER AND DISPENSER

BACKGROUND OF THE INVENTION

This invention relates generally to the handling of yarn and more particularly concerns the holding and dispensing of yarn from skeins for knitting and crocheting.

The yarn or other fiber used in knitting and crocheting is generally obtained by the consumer in skein form. The artisan then has the alternative of knitting or crocheting directly from the skein which frequently results in time consuming and irritating tangles or expenditures of tedious, non-productive time in rewinding the skein into a more usable ball form. More varied or complex color schemes and textures in the finished product increases the tangling and time consumption problems.

These problems are of no recent vintage, and many attempts to simplify either of the alternatives have been made. All of them have their drawbacks. Some of the devices are extremely complex and simply result in exchanging an old problem for a new one. Some are lacking in decorative quality and, therefore, require storage during set-down time. Some are difficult to take up and set down or inconvenient for transportation. It is an object of the present invention to provide a yarn dispenser and holder which will reduce the likelihood of tangles without the need for rewinding the yarn. Another object of the invention is to provide a yarn dispenser and holder which may be taken up or set down without the need for any additional steps in so doing. Another object of the invention is to provide a yarn dispenser and holder which is decorative and, therefore, can always be left in view and further to provide a dispenser and holder which can be conveniently adapted to changes in decor. It is another object of the invention to provide a yarn holder and dispenser which may be easily and compactly assembled and disassembled so that it may be readily transported by the artisan.

SUMMARY OF THE INVENTION

In accordance with the invention an assembly is provided for holding and dispensing yarn from a skein of yarn. A basket is detachably securable to a collapsible frame which supports and shapes the basket. The frame consists of two pairs of pivotally crossed legs with laterally opposite legs being connected to each other by horizontal upper and lower rods. The basket is made from a piece of substantially T-shaped cloth. The vertical part of the T is suspended from the upper horizontal rods and the lower horizontal rods serve to define the basket sides and bottom. The sides of the T-shaped material are folded parallel to the crossed legs to form the ends of the basket. The basket is secured in this shape by appropriate fasteners, perhaps a hook and loop type fastening device such as "VELCRO". One laterally opposite pair of legs extend beyond the horizontal rod which connects them by a distance not less than the radius of a skein of yarn. These upward extensions are journalled to removably hold a spindle which rotates in the journals. The spindle is slidable into a skein of yarn along the longitudinal axis and is pronged to assure that the skein will rotate with the spindle. Many skeins of yarn can be mounted on different spindles and stored in the basket ready for easy interchange in the journals during use or for convenient collapse of the frame and basket for transport purposes. The detachable basket is easily removed for change of decor or cleaning.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
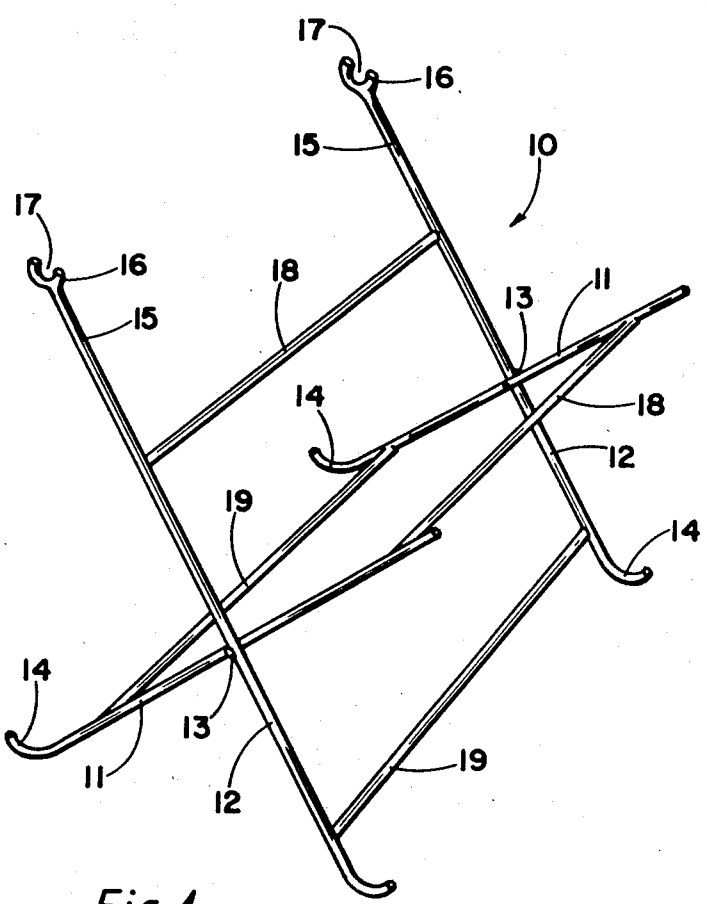
FIG. 1 is a perspective view of a preferred embodiment of the frame of the present invention.

Turning first to FIG. 1, a preferred embodiment of a frame 10 used in the present invention is illustrated. The frame 10 consists of two pairs of crossed legs 11 and 12 spaced apart in face to face relationship. Each pair of legs 11 and 12 is pivotally joined at approximately its midpoint by a pin 13 extending through holes (not shown) disposed through the legs 11 and 12 at their crossing point. All four of the legs 11 and 12 have lower extensions 14. The lower extensions 14 are upwardly and outwardly arched forming rounded bottoms which will rest on a table or other supporting surface (not shown). Two laterally opposite legs 12 have upper extensions 15. The upper extensions 15 terminate at their upper end in topwardly accesible C-shaped journals 16 having journal access openings 17. The oppositely facing legs of the pairs of legs are secured to each other by upper horizontal rods 18 and lower horizontal rods 19. The rods 18 and 19 are perpendicular to the legs 11 and 12 and are preferably fixed to the legs 11 and 12 at points equidistant from the pins 13.

Figure 4:
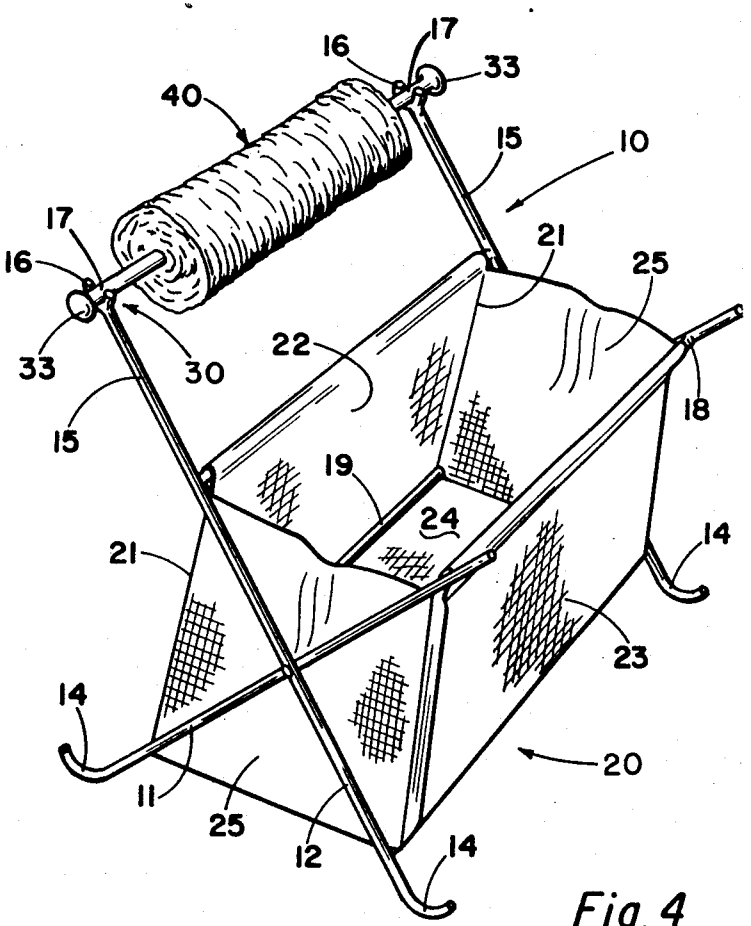
FIG. 4 is a perspective view of the elements of FIGS. 1 through 3 in the assembled condition.
Figure 2:
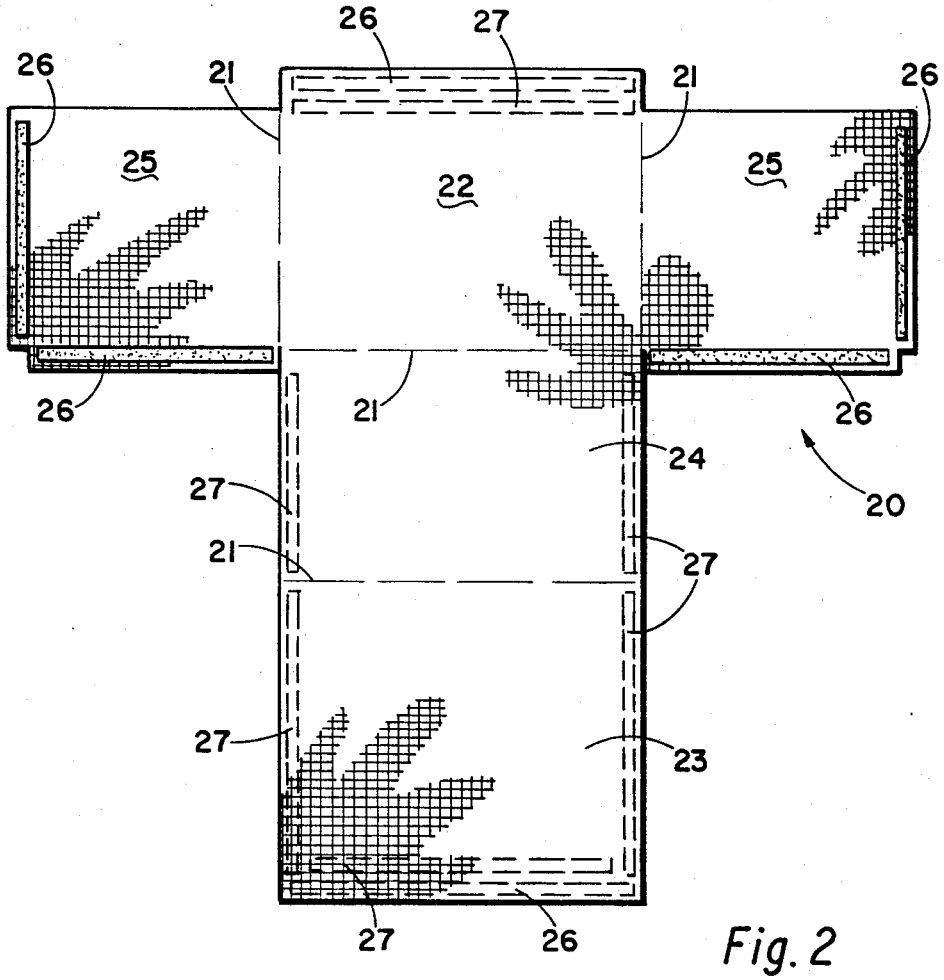
FIG. 2 is a plan of a preferred embodiment of the cloth basket of the present invention in a laid-out condition.

Turning now to FIG. 2, a basket 20 is shown in its laid out condition. The basket 20 may be made from any suitable cloth cut substantially to the shape of a T. For purposes of explanation, the cloth as illustrated in FIG. 2 is divided into sections by several fold lines 21 defining side panels 22 and 23, bottom panel 24 and end panels 25, so identified in reference to their ultimate location in the formed basket shown in FIG. 4. The upper edge of side panel 22 and the lower edge of side panel 23 are fitted with "VELCRO" striips 26 along the down face of the cloth as shown. The side and bottom edges of end panels 25 are fitted with "VELCRO" strips 26 along the upface of the cloth as shown. Strips of material 27 suitable for mating with the "VELCRO" strips 26 are provided on the down face of the cloth on the side edges of the bottom panel 24, the side panel 23 and inwardly from and parallel to the "VELCRO" strips 26 located on side panels 22 and 23. Other types of fastening devices, such as hooks, buttons, zippers and the like, may serve equally well.

Figure 3:
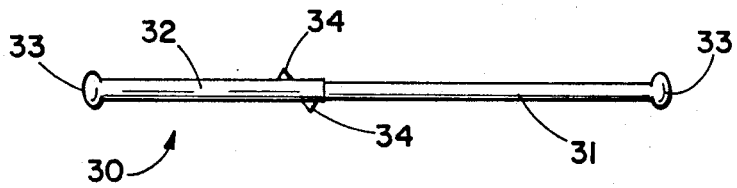
FIG. 3 is a perspective view of a preferred embodiment of the spindle of the present invention.

FIG. 3 illustrates a preferred embodiment of a spindle 30 for use with the present invention. The spindle 30 is preferably of telescoping nature, comprised of a thin rod 31 slidable against a friction grip within a hollow rod 32. The outer ends of the rods 31 and 32 are provided with knobs 33. One or more prongs 34 extend radially outwardly from the hollow rod 32.

Looking now at FIGS. 1 through 4, the assembly of the frame 10, the basket 20 and the spindle 30 will be explained. With the crossed legs 11 and 12 slightly open, perhaps at 5° to 45° angles to each other, and with the lower extensions 14 resting on a table or other surface, the "VELCRO" strip 26 of one side panel 22 is folded over one upper horizontal rod 18 and secured to its parallel adhering strip 27. The other side panel 13 is then passed around the lower horizontal rods 19 and the "VELCRO" strip 26 on this panel 23 is wrapped around the other upper horizontal rod 18 and secured to its associated parallel adhering strip 27. With the side panels 22 and 23 so connected to the upper horizontal rods 18, the crossed legs 11 and 12 are further separated to approximately 60° to 90° until the bottom 24 of the basket 20 is drawn into shape. The end panels 25 may then be folded inside the crossed legs 11 and 12 along their fold lines 21 and the side and bottom "VELCRO" strips 26 secured to their respective fastening strips 27 on the bottom panel 24 and the side panel 23. With the basket then completed, the telescoping spindle 30 may be slidably inserted into a skein of yarn 40 and the ends of the spindle 30 snapped through the journal openings 17 and into the journals 16. The inner diameters of the journals 16 are sized to permit free rotation of the spindle 30 within the journals 16. The openings 17 in the C-shaped journals 16 are sized to snugly receive the spindle 30 into the journals 16 so that the spindle 30 will not be inadvertently released from the journals 16 during use. The prongs 34 on the hollow rod 32 of the spindle 30 prevent slippage of a skein of yarn 40 during rotation of the spindle 30. The arched lower extensions 14 prevent tipping of the holder during use. Disassembly of the yarn holder and dispenser may be rapidly accomplished by reversing the procedure above outlined.

By using several spindles 30, yarns of various colors and textures can be stored in condition ready for use in the basket 20. Since the basket 20 is completely separable from the frame, it may be easily be washed or replaced. The frame 10 and spindle 30 will preferably be formed of slightly flexible solid plastic rods to provide a sturdy but lightweight holder which can readily be folded into a more compact condition for transportation with the artisan, but wood or metal, solid or tubular, may also be used.

Thus, it is apparent that there has been provided, in accordance with the invention, a yarn holder and dispenser that fully satisfies the objects, aims and advantages set forth above. While the invention has been described in connection with a specific embodiment thereof, it is evident that many alternatives, modifications and variations will be apparent to those skilled in the art in light of the foregoing description. Accordingly, it is intended to embrace all such alternatives, modifications and variations as fall within the spirit of the appended claims.

What is claimed is:

1. An assembly for holding and dispensing yarn from a skein of yarn comprising:

a spindle slidably insertable into a skein of yarn;

a cloth basket;

two pairs of crossed legs oppositely faced along parallel planes;

means extending upwardly from said pairs of crossed legs;

means disposed on said extending means for removably and rotatably engaging said spindle in a horizontal attitude between said planes;

means connecting opposite ones of said crossed legs for suspending said basket therebetween;

means connecting opposite ones of said crossed legs cooperable with said suspending means for shaping said basket; and means for detachably securing said basket to said suspending means with said shaping means disposed in said basket.

2. An assembly according to claim 1, said pairs of crossed legs each having means connecting their respective legs proximate their midpoint for rotation parallel to said planes.

3. An assembly according to claim 1, said spindle comprising a rod disposed for frictional sliding disposition within a hollow rod for telescoping said spindle to selected lengths.

4. An assembly according to claim 1, said spindle having means extending radially therefrom to prevent rotational slip of a skein of yarn about said spindle.

5. An assembly for holding and dispensing yarn from a skein of yarn comprising:

a collapsible frame having two pairs of crossed legs oppositely disposed along parallel planes;

a pair of pins, one each pivotally connecting one pair of said crossed legs proximate thier midpoint;

a pair of lower horizontal rods, one each rigidly connecting the lower portions of opposite crossed legs; and a pair of upper horizontal rods, one each rigidly connecting the upper portions of opposite crossed legs;

a pair of extension members of equal length, one each integrally upwardly extending from the upper portions of opposite crossed legs for a distance not less than the radius of a skein, each of said members having a journal integrally disposed on its upper end;

a spindle removably and rotatably disposed in said journals and slidably insertable into the skein along its longitudinal axis;

a cloth basket; and means for detachably suspending said basket from said upper rods with said lower rods disposed within and shaping said basket.

6. An assembly according to claim 5, the connecting points of each of said rods to said legs being equidistant from the associated one of said pins.

7. An assembly according to claim 6, each of said legs comprising a straight rod.

8. An assembly according to claim 7 each of said extension members being an integral straight rod extension of its respective leg.

9. An assembly according to claim 8, each of said journals comprising a topwardly accessible C-shaped seat of inner diameter greater than the outer diameter of the spindle.

10. An assembly according to claim 9, the access of each of said seats being dimensioned for snug reception of said spindle therethrough into said seat.

11. An assembly according to claim 10, each end of said spindle having a knob disposed thereon larger than the inner diameter of said journals.

12. An assembly according to claim 11, each of said legs further having a lower extension integrally arching outwardly and upwardly from the lower end thereof.

13. An assembly according to claim 5, said basket comprising a piece of fabric cut in a T-shape, the vertical portion of said T-shape fabric being folded to form the sides and bottom of said basket and the side portion of said T-shape fabric being folded to form the ends of said basket.

14. An assembly according to claim 13, said means comprising mating strips of hook and loop type fasteners.

15. An assembly for holding and dispensing yarn from a skein of yarn comprising:

a collapsible frame having two pairs of crossed rods oppositely disposed along parallel planes;

a pair of pins, one each pivotally connecting one pair of said crossed rods proximate their midpoint;

a pair of lower horizontal rods, one each rigidly connecting the lower portions of opposite crossed rods; and a pair of upper horizontal rods, one each rigidly connecting the upper portions of opposite crossed rods;

said lower and upper horizontal rods being equidistant from said pins;

a pair of upper straight rod extensions, one each integrally extending from the upper portion of one of the two oppositely faced crossed rods for a distance not less than the radius of the skein;

a pair of outwardly accessible C-shaped journals, one each integrally disposed on the upper end of one of said upper straight rod extensions;

a spindle removably and rotatably disposed in said journals and slidably insertable into the skein;

a basket formed from a substantially T-shaped piece of cloth, said piece of cloth having means disposed therein for detachably holding said piece of cloth in the assembled condition of a basket and further having means disposed thereon for detachably suspending said basket from said upper horizontal rods with said lower horizontal rods disposed in said basket, said upper horizontal rods and said lower horizontal rods being operable to shape said basket.

16. An assembly according to claim 15, each of said crossed rods having a lower extension integrally arching outwardly and upwardly from its lower end.

17. An assembly according to claim 16, said spindle comprising first and second rods, said first being slidably frictionally gripped within said second rod to permit selective varying of the length of said spindle.

18. An assembly according to claim 17, said spindle having means disposed thereon for preventing lateral disengagement of said spindle from said journals.

19. An assembly according to claim 18, said second rod having at least two prongs integrally, outwardly, radially extending therefrom in different directions.

20. An assembly according to claim 18, said preventing means comprising a pair of knobs, one integrally disposed on each of said spindle.

21. An assembly for holding and dispensing yarn from a skein of yarn comprising:

a frame having two pairs of crossed legs oppositely disposed along parallel planes, means connecting each pair of said crossed legs proximate their midpoint for rotation parallel to said planes, a pair of lower horizontal rods rigidly connecting the lower portions of opposite crossed legs and a pair of upper horizontal rods rigidly connecting the upper portions of opposite crossed legs;

a pair of extension members integrally upwardly extending from the upper portions of opposite crossed legs, each of said members having a journal integrally disposed thereon spaced from the upper horizontal rod of its legs by a distance not less than the radius of a skein;

a spindle removably and rotatably disposed in said journals and slidably insertable into the skein;

a cloth basket; and means for detachably suspending said basket from said upper rods with said lower rods disposed within and shaping said basket.

* * * * *